US005628116A

United States Patent [19]

Kohno

[11] Patent Number: 5,628,116

[45] Date of Patent: May 13, 1997

[54] BEARING USABLE FOR SCISSORS AND SCISSORS USING THE SAME

[75] Inventor: Yoshifusa Kohno, Takarazuka, Japan

[73] Assignee: Kabushiki Kaisha Naruto, Hyogo, Japan

[21] Appl. No.: 411,647

[22] PCT Filed: Jul. 7, 1994

[86] PCT No.: PCT/JP94/01116

§ 371 Date: Apr. 4, 1995

§ 102(e) Date: Apr. 4, 1995

[87] PCT Pub. No.: WO95/35189

PCT Pub. Date: Dec. 28, 1995

[30] Foreign Application Priority Data

Jun. 17, 1994 [JP] Japan ..... 6-135285

[51] Int. Cl.[6] ..... B26B 13/28

[52] U.S. Cl. ..... 30/267; 30/266; 384/607; 384/614

[58] Field of Search ..... 30/254, 266, 267, 30/268; 384/445, 607, 614

[56] References Cited

U.S. PATENT DOCUMENTS

| | | | |
|---|---|---|---|
| 672,050 | 4/1901 | Williamson | 30/267 |
| 2,032,281 | 2/1936 | Haywood | 30/267 |
| 2,307,489 | 1/1943 | Coats | 30/267 |
| 3,611,570 | 10/1971 | Laurenti | 30/268 |
| 4,120,543 | 10/1978 | Greene, Jr. et al. | 384/607 |
| 4,541,744 | 9/1985 | Lederman | 384/614 |
| 5,263,779 | 11/1993 | Sakaguchi et al. | 384/614 |

FOREIGN PATENT DOCUMENTS

| | | |
|---|---|---|
| 49-10037 | 3/1974 | Japan . |
| 49-31511 | 8/1974 | Japan . |
| 5548477 | 9/1978 | Japan . |
| 5-57442 | 7/1993 | Japan . |

*Primary Examiner*—Hwei-Siu Payer
*Attorney, Agent, or Firm*—Seed and Berry LLP

[57] ABSTRACT

There is disclosed a bearing (4) usable for scissors, including a disk-shaped holding plate (44) and a plurality of steel balls (4). The holding plate (44) is provided with a plurality of steel ball holding apertures (41) for rotatably holding the steel balls (40) under a condition where the spherical surface of each steel ball (40) is projected beyond either side of the holding plate (44); and, at a peripheral edge portion of each steel ball holding aperture (41), and at an outer peripheral edge portion of the holding plate (44), foreign material blocking barriers (42, 43) are respectively formed taken along the entire peripheral edge portions so as to each have a height lower than the height of the projecting portion of each steel ball (40). There is also disclosed a pair of scissors, in which groove parts (21, 31) are respectively formed on contacting surfaces of a moving blade (2) and a stationary blade (3) to mate with each other; and the groove parts (21, 31) are pivotally connected to each other by using a spindle pin (5) and a set screw (6) under a condition where the above bearing (4) is sandwiched therebetween.

9 Claims, 6 Drawing Sheets

BEARING USABLE FOR SCISSORS AND SCISSORS USING THE SAME

TECHNICAL FIELD

The present invention relates to a bearing usable for scissors and scissors using the same.

BACKGROUND ART

Generally, a pair of scissors is required to have excellent rotatability and durability. Therefore, especially, a pair of scissors to be used in a barber-beautyparlor field has conventionally been known, in which groove parts are respectively formed on contacting surfaces of a moving blade and a stationary blade to mate with each other; and these groove parts are pivotally connected to each other by using a spindle pin and a set screw under a condition where a bearing, which holds a plurality of steel balls, is sandwiched therebetween. That is, according to the pair of scissors, an excellent rotational movement of the moving blade and the stationary blade can be maintained due to smooth rotational movement of the steel balls held by the bearing.

However, according to such a pair of scissors, chips of cut hair and dusts are likely to enter between the bearing and the steel ball through long use; and this disadvantageously hinders the smooth rotational movement of the steel balls.

In addition, once such chips enter, they become very hard to be removed, and consequently, the bearing is required to be replaced with a new one, thereby raising a problem of high maintenance cost or the like.

The present invention, which is made considering such disadvantages of prior art, has an object to provide a pair of scissors capable of maintaining the smooth rotational movement for a long time by means of preventing entrance of chips and/or dusts.

DISCLOSURE OF INVENTION

A bearing usable for scissors according to the present invention, including a disk-shaped holding plate and a plurality of steel balls, the holding plate having front and rear sides, and an aperture at the central thereof, through which a spindle pin of the scissors pierces. A plurality of steel ball holding apertures are annularly arranged around the above aperture, for rotatably holding the above steel balls under a condition where the spherical surface of each steel ball, is projected beyond either side of the holding plate. The steel balls are held in the steel ball holding apertures one by one. At a peripheral edge portion of each steel ball holding aperture on either side of the holding plate, and at an outer peripheral edge portion of the holding plate, a foreign material blocking barrier is formed taken along the respective entire peripheral edge portions so as to each have a height lower than the height of the projecting portion of each steel ball. Therefore, chips, dusts, and the like entering around the bearing will have difficulty to further enter the steel ball holding aperture of the holding plate due to the presence of the foreign material blocking barriers. Thus, the function of the bearing can be maintained for a long period. In addition, with such a simple structure, a working system such as an assembly or disassembly step for scissors would not become complicated, and the manufacturing cost can be held down, thereby making it possible to provide a pair of scissors easy to handle and economic.

Furthermore, according to a pair of scissors of the present invention, the thus constructed bearing is provided so as to be sandwiched by the contacting surfaces of the blades.

Therefore, the pair of scissors can maintain excellent rotatability of a moving blade and a stationary blade for a long time. In addition, the pair of scissors need not be frequently cared, and inferiority of the bearing due to entrance of chips can be prevented, thereby reducing the maintenance cost.

BRIEF DESCRIPTION OF DRAWINGS

FIG. 2(*b*) is a cross-sectional view taken along a line II to II of FIG. 2 (*a*);

FIG. 3 (*b*) is a side view illustrating another example of the arc-shaped plate spring to be used for the hair cutting scissors shown in FIG. 1;

BEST MODE FOR CARRYING OUT THE INVENTION

The present invention will be described in more detail with reference to attached drawings.

Figure 1:
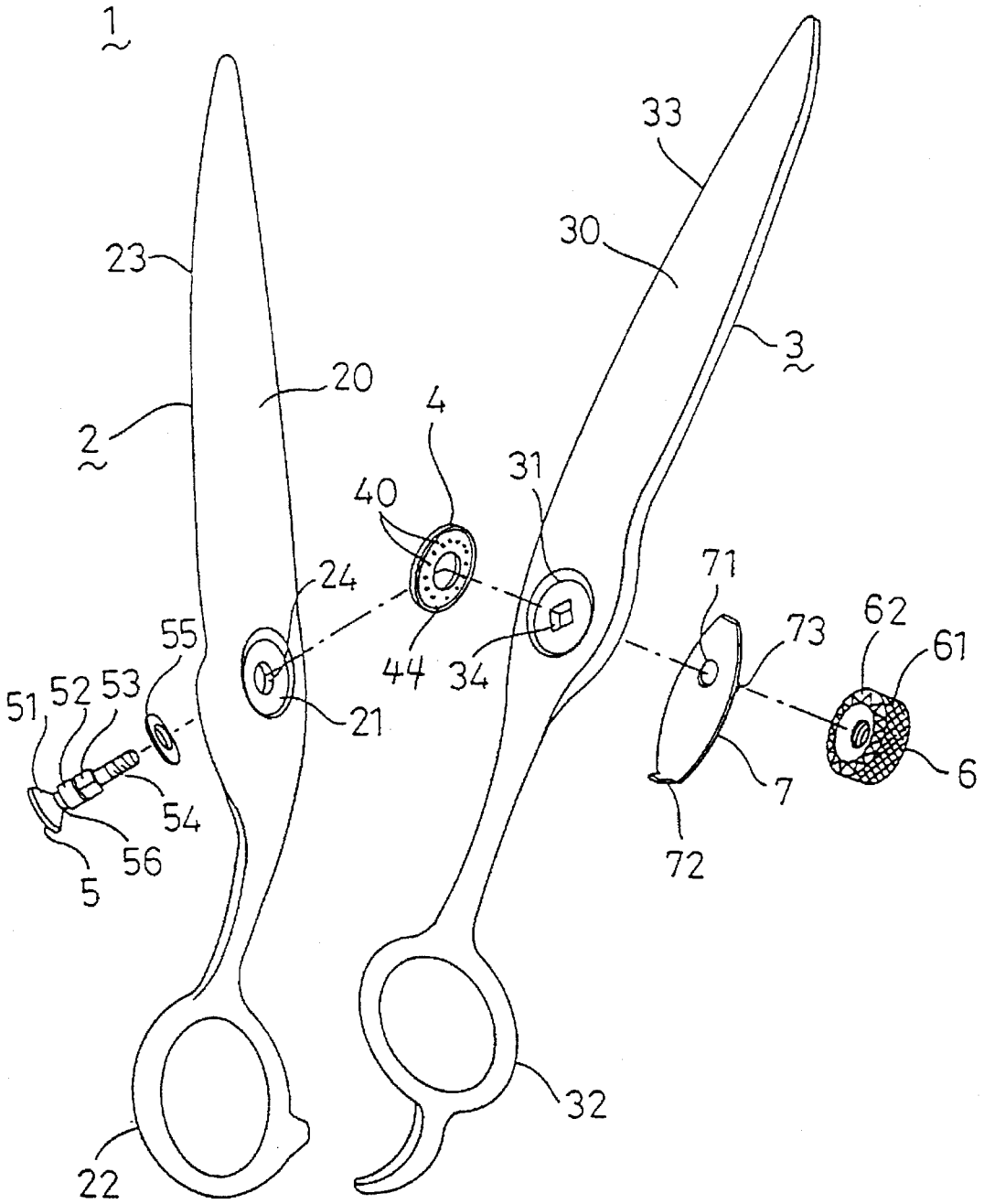
FIG. 1 is an exploded perspective view showing a bearing usable for scissors, and a pair of hair cutting scissors according to the present invention.
Figure 2A:
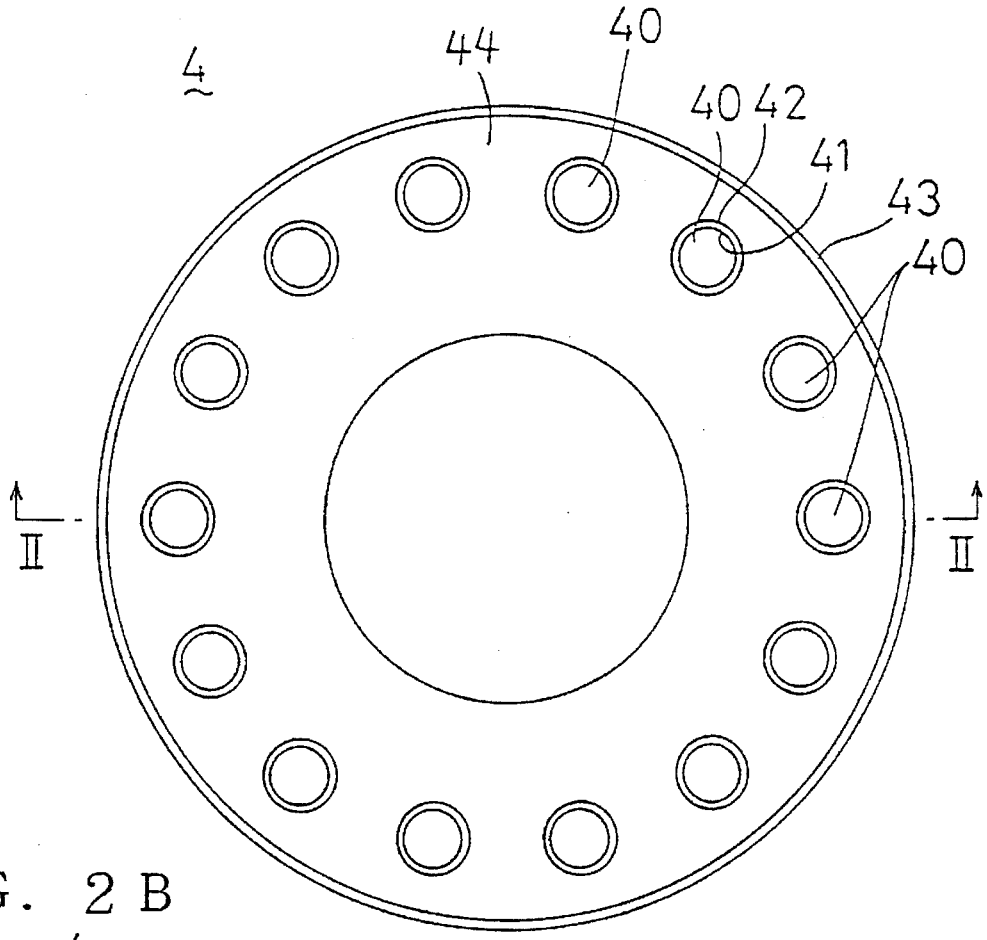
FIG. 2(*a*) is a front view showing a bearing usable for scissors according to the present invention.
Figure 2B:
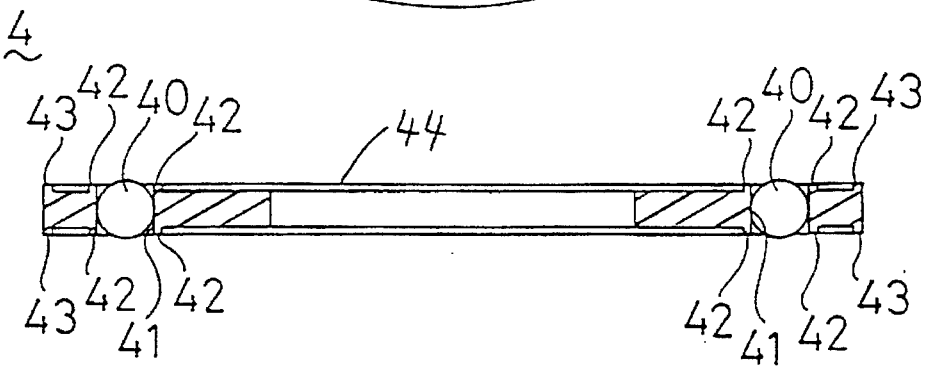

FIG. 1 schematically shows a general structure of a pair of scissors 1, and FIG. 2 shows a bearing 4 usable for the scissors.

That is, according to the pair of scissors 1, groove parts 21 and 31 are respectively formed on contacting surfaces 20 and 30 of a moving blade 2 and a stationary blade 3 to mate with each other; and these parts are pivotally connected to each other by using a spindle pin 5 and a set screw 6 under a condition where a bearing 4, which holds a plurality of steel balls 40, is sandwiched therebetween. The groove part 21 formed at the contacting surface 20 of the moving blade 2 is made in a circular shape so that the depth thereof is successively and gradually increased in a direction from a handle part 22 to a blade edge part 23 of the moving blade 2. Furthermore, a spindle aperture 24 having a conical shape is pierced through a central portion of the groove part so as to pass through the moving blade 2.

In the same manner as that of the groove part 21 of the moving blade 2, the groove part 31 formed at the contacting surface 30 of the stationary blade 3 is also formed in a circular shape so that the depth thereof is successively and gradually increased in a direction from a handle part 32 to a blade edge part 33 of the stationary blade 3. Moreover, a spindle aperture 34 having a square-pole-shape is pierced through a central portion of the groove part 31 so as to pass through the stationary blade 3.

The bearing 4 is constructed of a plurality of steel balls 40 and a disk-shaped holding plate 44 having front and rear sides. On the holding plate 44, a plurality of steel ball holding apertures 41 are annularly arranged for rotatably holding the steel balls 40 under a condition where the spherical surface of each steel ball 40 is projected beyond either side of the holding plate 44. The steel balls 40 are held in the steel ball holding apertures 41 one by one. In addition, at a peripheral edge portion of each steel ball holding aperture on either side of the holding plate, and at an outer peripheral edge portion of the holding plate, foreign material blocking barriers 42 and 43 are respectively formed taken along the entire peripheral edge portions so as to each have a height lower than the height of the projecting portion of each steel ball 40. The steel ball 40 may be just entered within the steel ball holding aperture 41, or alternatively it may be rotatably inserted in the steel ball holding aperture 41. Especially, in a case where the steel ball 40 is rotatably inserted in the steel ball holding aperture 41, the holding plate 44 and the steel ball 40 can conveniently be handled as an integrated unit without scattering or losing any of the steel bails 40.

The spindle pin 5 is constructed by successively arranging, from a base edge portion of a head part 51, a shaft part 52, a square shaft part 53, and a screw shaft part 54 in this order. At a base edge portion of the shaft part 52, a holding groove part 56 is annularly arranged for holding a washer 55. By holding the washer 55 in this holding groove part 56 so as to be engaged therewith, it becomes possible to prevent the washer 55 from slipping off the spindle pin 5, thereby making it easy to perform an assembly work.

The set screw 6 is made so as to be screwed into the screw shaft part 54 of the spindle pin 5. At the outer surface of the set screw 6, a slippage preventing part 61 is formed to be knurled for the purpose of making it easy to handle the set screw 6 with fingers. In addition, a pawl toothed wheel 62 is annually arranged at an inner surface of the set screw 6 to mate with arc-shaped plate spring 7.

According to the thus constructed scissors 1, the spindle pin 5 is passed through the moving blade 2, the bearing 4, and the stationary blade 3 in this order so that the head part 51, the shaft part 52, and the square shaft part 53 of the spindle pin 5 may be located corresponding to the spindle aperture 24 of the moving blade 2, the bearing 4, and the spindle aperture 34 of the stationary blade 3, respectively. Then, the set screw 6 is screwed into the screw shaft part 54 projecting outside of the stationary blade 3, via an arc-shaped plate spring 7.

Figure 3A:
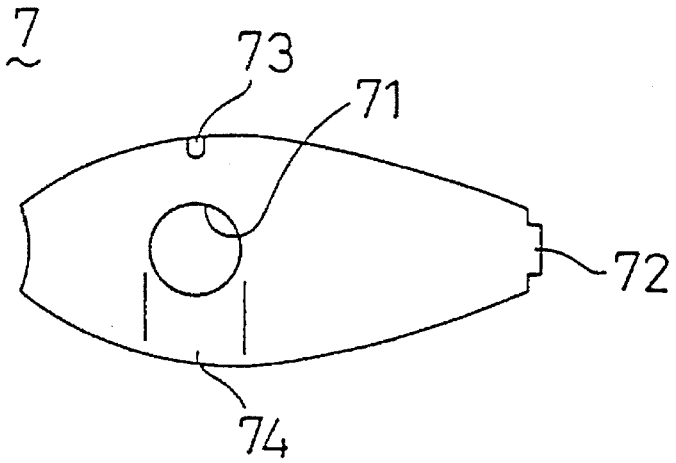
FIG. 3(*a*) is a plan view illustrating another example of an arc-shaped plate spring to be used for the hair cutting scissors shown in FIG. 1.
Figure 3B:
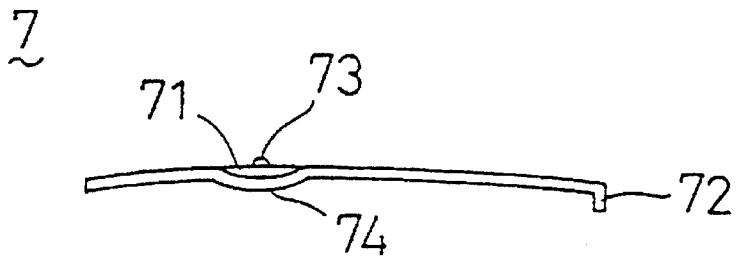

This arc-shaped plate spring 7 is provided with An aperture 71 piercing through the spindle pin 5. A checking piece 72 is projectively arranged at an edge portion of the plate spring 7 so as to be engaged with a checking aperture 35 provided at the stationary blade 3. According as the set screw 6 is screwed into the spindle pin 5, the arc-shaped plate spring 7 is gradually straightened. It is the resilience of the arc-shaped plate 7 generated at this time that determines the resistance to the rotational movement of the steel balls 40 of the bearing 4 with respect to the moving blade 2 and the stationary blade 3 sandwiching the steel balls 40 therebetween. That is, in a case where the set screw 6 is screwed tightly and the resilience of the arc-shaped plate spring 7 is heightened, the rotational movement of the moving blade 2 and the stationary blade 3 will be heavy. On the other hand, in a case where the set screw 6 is screwed loosely and the resilience of the arc-shaped plate spring 7 is lowered, the rotational movement of the moving blade 2 and the stationary blade 3 will be light. Thus, the resistance to the rotational movement can readily be adjusted by appropriately adjusting the degree of tightness for screwing the set screw 6 in accordance with the user's preference. Furthermore, in order not to loosen the thus adjusted set screw 6, a protruding portion 73 is protuberantly arranged on the arc-shaped plate spring 7 so as to engage with the pawl toothed wheel 62 of the set screw 6. Thus, the set screw 6 is made so as to be rotationally moved intermittently. In addition, as shown in FIG. 3, a reinforcing portion 74 may be formed in a vicinity of the aperture 71 of the arc-shaped plate spring 7 so as to be uneven in a thickness thereof. In this case, the resilience of the arc-shaped plate spring 7 itself becomes stronger in the vicinity of the aperture 71. Therefore, the pawl toothed wheel 62 of the set screw 6 can stably be engaged with the protruding portion 73 when the set screw 6 is screwed, regardless of the degree of tightness for screwing the set screw 6. This makes it smooth to adjust the resistance to the rotational movement.

As is described above, the pair of scissors 1 can be made easy to handle by means of adjusting the degree of tightness for screwing the set screw 6 and adjusting the resistance to the rotational movement of the moving blade 2 and the stationary blade 3 with respect to the steel balls 40 sandwiched therebetween. Furthermore, the steel bails 40 are held at prescribed portions of the groove parts 21 and 31 by means of the holding plate 44 of the bearing 4, thereby making it possible to maintain the stable rotational movement of the steel balls 40.

Figure 4:
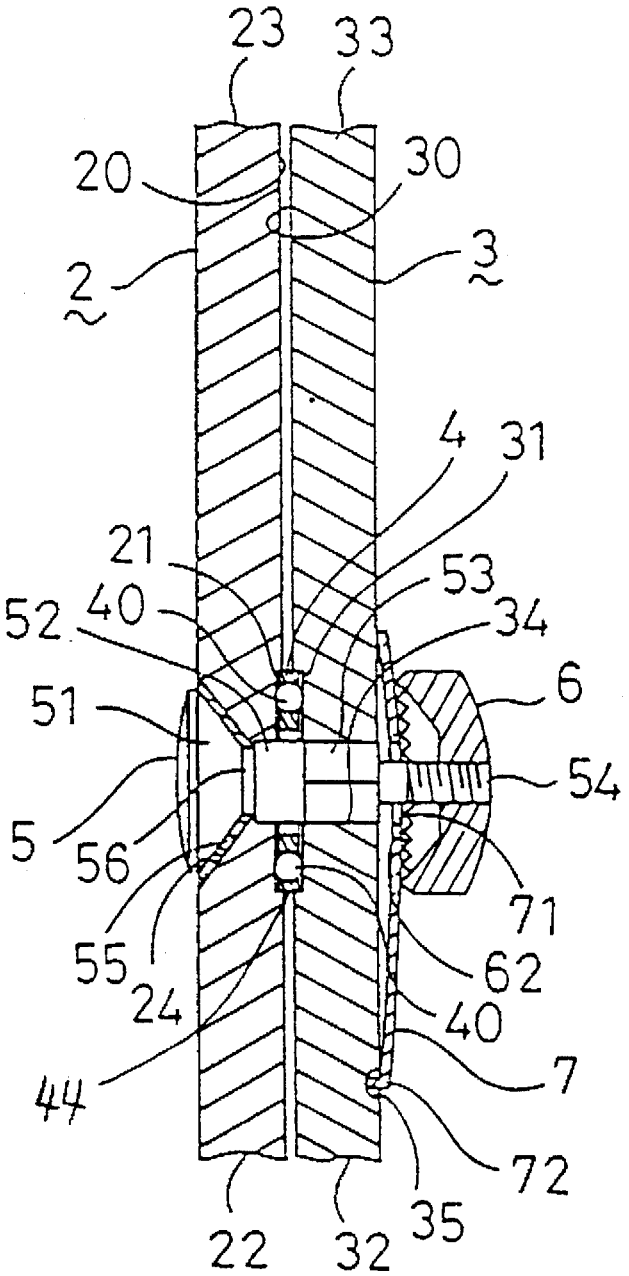
FIG. 4 is a partial cross-sectional view showing a spindle part of the hair cutting scissors shown in FIG. 1.

The thus constructed pair of scissors 1 has a structure in which the groove parts 21 and 31 are each formed so that the depth thereof is successively and gradually increased in a direction from the handle part 22 or 32 to the blade edge part 23 or 33. Therefore, as the two blades of the scissors 1 are rotationally moved from an open state to a closed state, a condition where the shallow portion and the deep portion of one of the groove parts 21 and 31 are respectively opposite to the deep portion and the shallow portion of the other one is shifted to a condition where the shallow portions are opposite each other and the deep portions are opposite each other. Accordingly, as shown in FIG. 4, under a state where the pair of scissors 1 is closed, the steel balls 40 located at the shallow portions of the groove parts 21 and 31 are strongly grasped. As a result, the handle parts 22 and 32 are forced to enlarge the gap therebetween, while the blade edge parts 23 and 33 are forced to get closer to each other; and whereby the blade edge parts 23 and 33 can appropriately be slid across each other. Thus, during use, every time the blades of the scissors 1 are opened or closed, the grip space between the groove parts 21 and 31 is changed. Therefore, in a case of hair cutting scissors, there is some concern about a possibility that chips such as cut hair will disadvantageously enter between the groove parts 21 and 31. However, according to the present scissors 1, entrance of such chips can be blocked due to the presence of the foreign material blocking barrier 42 provided at the outer peripheral portion of the holding plate 44 of the bearing 4. Even if such chips should enter between the groove parts 21 and 31, the further entrance of such chips can be blocked due to the presence of the foreign material blocking barrier 43 provided along the peripheral portion of the steel ball holding aperture 41. As a result, the entrance of chips between the steel ball holding aperture 41 and the steel ball 40 can be avoided, and therefore the smooth rotational movement of the steel ball 40 would not be deteriorated. Thus, the smooth rotational movement can be maintained for a long time.

Figure 5:
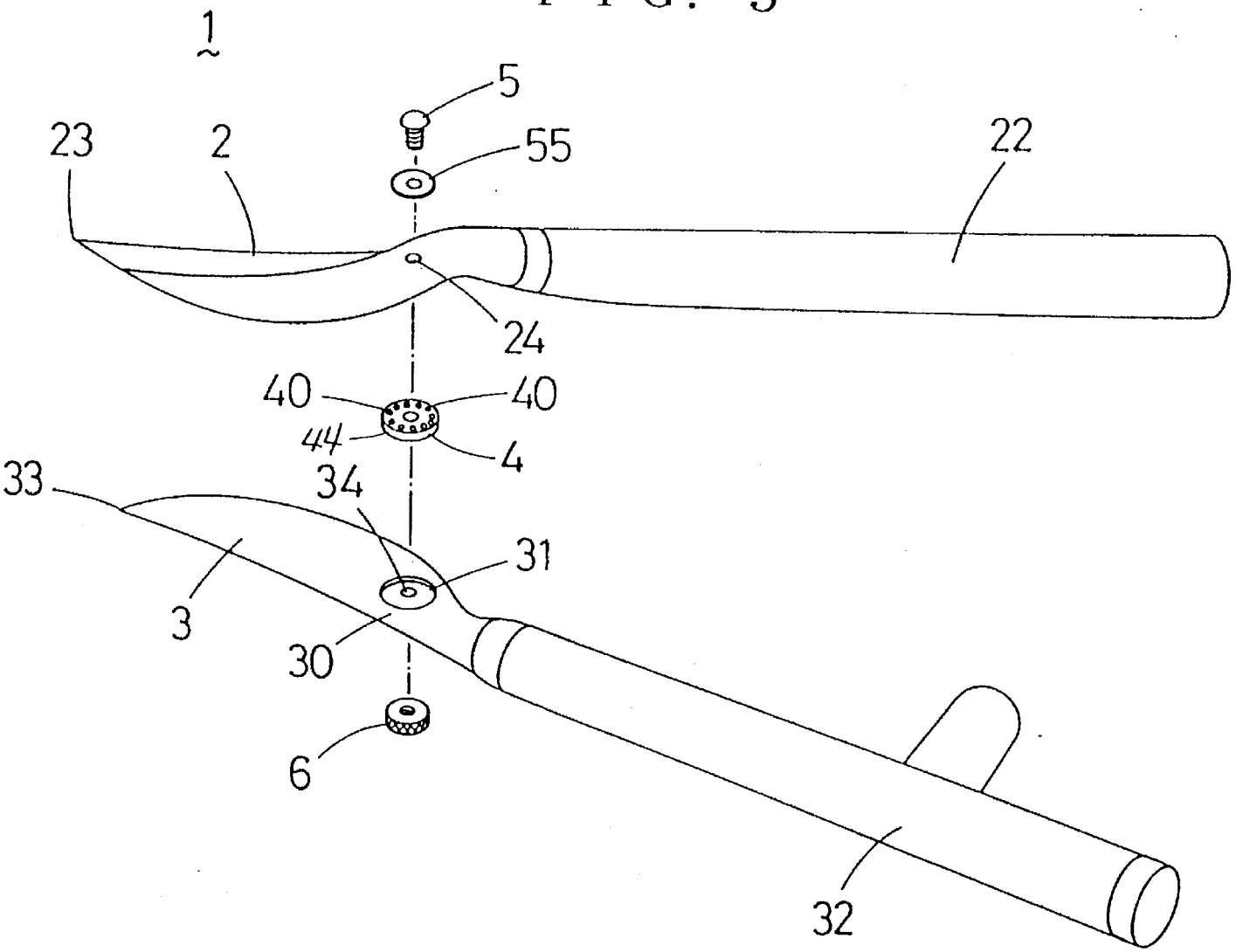
FIG. 5 is an exploded perspective view showing a pair of garden shears according to another example of the present invention.

FIG. 5 is an exploded perspective view showing a pair of garden shears according to another example of the present invention. The pair of garden shears also has the same structure as that of the example illustrated in FIGS. 1 to 4. The pair of garden shears can also perform smooth rotational movement by employing the bearing 4, thereby making it easy to perform relatively hard work such as plant shearing work.

Figure 6:
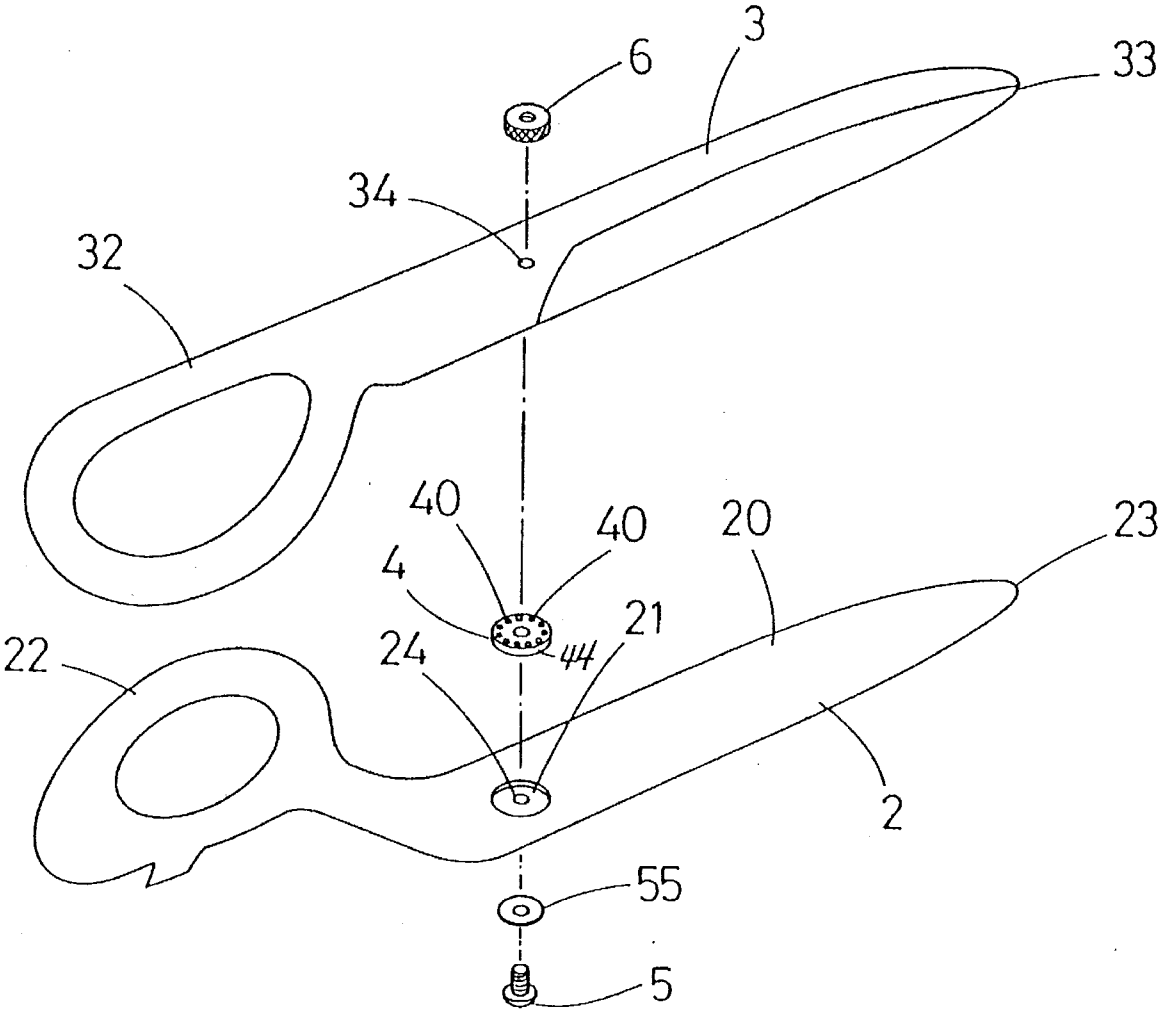
FIG. 6 is an exploded perspective view showing a pair of sewing scissors according to still another example of the present invention.

FIG. 6 is an exploded perspective view showing a pair of sewing scissors according to still another example of the present invention. The pair of sewing scissors also has the same structure as that of the example illustrated in FIGS. 1 to 4. According to the pair of sewing scissors, it is also possible to readily cut a piece of paper or cloth by employing the bearing 4.

In FIGS. 5 and 6, the same reference numerals are given to the same elements as those of the example illustrated in FIGS. 1 to 4.

Industrial Applicability

As is described above, the bearing usable for scissors according to the present invention can be applied to every kinds of scissors, including the hair cutting scissors. Especially it is preferably applied for scissors in which blades are frequently opened and closed.

I claim:

1. A pair of scissors, wherein groove parts are respectively formed on contacting surfaces of a moving blade and a stationary blade to mate with each other; the groove parts are pivotally connected to each other by using a spindle pin and a set screw under a condition where a bearing is sandwiched therebetween; the bearing includes a disk-shaped holding plate and a plurality of steel balls, the holding plate having front and rear sides, and an aperture at a central portion thereof, through which a spindle pin of the scissors pierces; a plurality of steel ball holding apertures are annularly arranged around the aperture on the holding plate, for rotatably holding the steel balls under a condition where the spherical surface of each steel ball is projected beyond either side of the holding plate; the steel balls are held in the steel ball holding apertures one by one; and, at a peripheral edge portion of each steel ball holding aperture on either side of the holding plate, and at an outer peripheral edge portion of the holding plate, a foreign material blocking barrier is formed taken along the respective entire peripheral edge portions so as to have a height lower than the height of the projecting surface of each steel ball.

2. A pair of scissors according to claim 1, wherein the groove parts respectively formed at the moving blade and the stationary blade are made so that each depth thereof is successively and gradually increased.

3. A pair of scissors according to claim 2, wherein an arc-shaped plate spring is further provided between the moving blade and the set screw; and resistance to rotational movement of the steel balls of the bearing with respect to the moving blade and the stationary blade sandwiching the steel balls can be adjusted by using resilience of the arc-shaped plate spring.

4. A pair of scissors according to claim 3, wherein a protruding portion is further formed on a front surface of the arc-shaped plate spring, and a pawl toothed wheel is formed on a rear side of the set screw so as to engage with the protruding portion; and with engagement of the protruding portion and the pawl toothed wheel, the set screw can be rotationally moved intermittently.

5. A pair of scissors according to claim 4, wherein a concave reinforcing portion is formed on the arc-shaped plate spring so as to face a lower surface of the set screw.

6. A pair of scissors according to claim 1, wherein an arc-shaped plate spring is further provided between the moving blade and the set screw; and resistance to rotational movement of the steel balls of the bearing with respect to the moving blade and the stationary blade sandwiching the steel balls can be adjusted by using resilience of the arc-shaped plate spring.

7. A pair of scissors according to claim 6, wherein a protruding portion is further formed on a front surface of the arc-shaped plate spring, and a pawl toothed wheel is formed on a rear side of the set screw so as the engage with the protruding portion; and with engagement of the protruding portion and the pawl toothed wheel, the set screw can be rotationally moved intermittently.

8. A pair of scissors according to claim 7, wherein a concave reinforcing portion is formed on the arc-shaped plate spring so as to face a lower surface of the set screw.

9. A bearing usable for scissors, comprising a disk-shaped holding plate and a plurality of steel balls, the holding plate having front and rear sides, and an aperture at a central portion thereof, through which a spindle pin of the scissors pierces; wherein a plurality of steel ball holding apertures are annularly arranged around the aperture on the holding plate, for rotatably holding the steel balls under a condition where the spherical surface of each steel ball is projected beyond either side of the holding plate; the steel balls are held in the steel ball holding apertures one by one; and, at a peripheral edge portion of each steel ball holding aperture on either side of the holding plate, and at an outer peripheral edge portion of the holding plate, a foreign material blocking barrier is formed taken along the respective entire peripheral edge portions so as to have a height lower than the height of the projecting surface of each steel ball.

* * * * *